United States Patent [19]

Hartshorn

[11] Patent Number: 4,531,541

[45] Date of Patent: Jul. 30, 1985

[54] PLATE-TYPE VALVE, AND AN IMPROVED VALVE SEAT AND A VALVE SEAT ASSEMBLY THEREFOR

[75] Inventor: Kevin Hartshorn, Plainsboro, N.J.

[73] Assignee: Ingersoll-Rand Company, Woodcliff Lake, N.J.

[21] Appl. No.: 580,831

[22] Filed: Feb. 16, 1984

[51] Int. Cl.[3] ..... F16K 21/04; F16K 21/10

[52] U.S. Cl. ..... 137/514; 137/516.29; 251/64

[58] Field of Search ..... 137/514, 516.21, 516.29, 137/516.27; 251/64; 92/85 R

[56] References Cited

U.S. PATENT DOCUMENTS

| | | | |
|---|---|---|---|
| 2,578,590 | 11/1951 | Perrault | 137/514 |
| 3,037,523 | 6/1962 | Szaniszlo | 137/514 |
| 3,177,893 | 4/1965 | King | 137/514 |
| 3,703,912 | 11/1972 | Bauer et al. | 137/514 |
| 3,837,357 | 9/1974 | Slaughter, Jr. | 137/516.29 |
| 3,857,408 | 12/1974 | Rhodes et al. | 137/514 |
| 4,259,858 | 4/1981 | Freeman et al. | 92/85 R |
| 4,398,559 | 8/1983 | Bunn et al. | 137/514 |

FOREIGN PATENT DOCUMENTS

| | | | |
|---|---|---|---|
| 147053 | 5/1936 | Fed. Rep. of Germany | 137/514 |

*Primary Examiner*—Alan Cohan
*Assistant Examiner*—John A. Rivell
*Attorney, Agent, or Firm*—Bernard J. Murphy

[57] ABSTRACT

The invention, according to the first embodiment depicted, comprises a plate-type valve having a valving element movable between a valve guard and a valve seat. The movable valving element has a plurality of flow ports formed therein each of which communicates with a port formed in the valve guard. Too, the valve seat has ports formed therein, but the latter are out of registry with the valving element and valve guard ports. Accordingly, with the element closed upon the valve seat, fluid flow through the valve is prevented, and with the valving element removed from the seat, fluid flow is accommodated. Movement of the valving element away from and then onto the valve seat subjects the ends of the ports in the valving element to fatigue, failure and fracture. The valve seat has a circular recess formed therein, whereat the periphery of the valving element would impact, and loosely set in the recess is an impact ring. Accordingly, the shock of impact of the plate-type element on closing is less likely to precipitate fatigue and failure of the port ends; the periphery of the valving element impacts upon the impact ring, and the latter dissipates the impact forces.

8 Claims, 6 Drawing Figures

Figure 4:
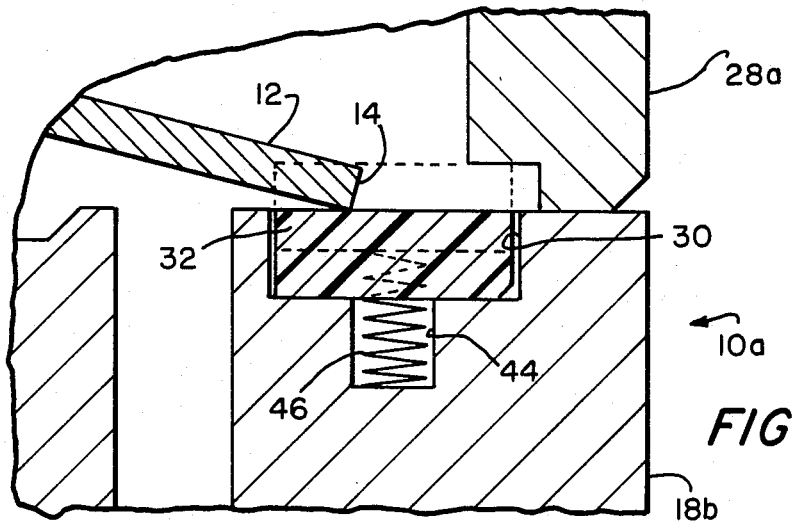

FIG. 1A
PRIOR ART
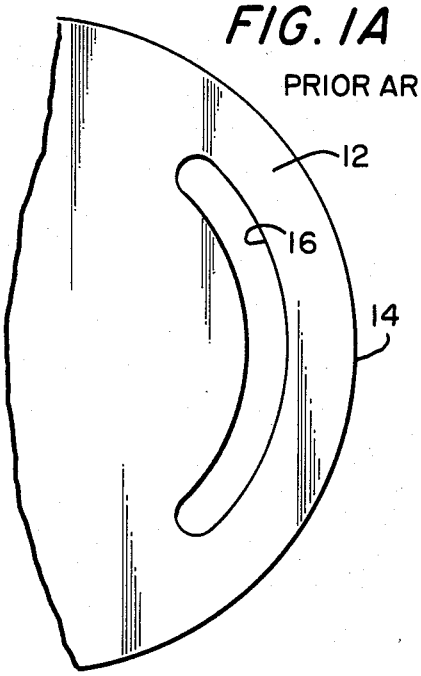
FIG. 2A
PRIOR ART
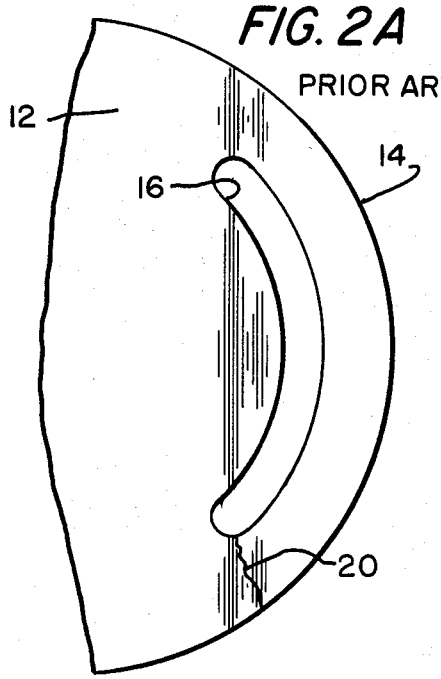
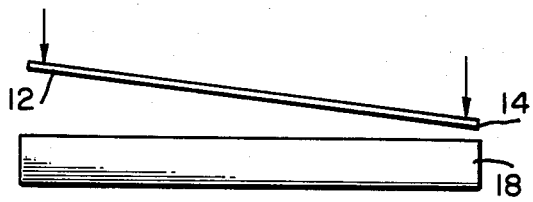
PRIOR ART FIG. 1B
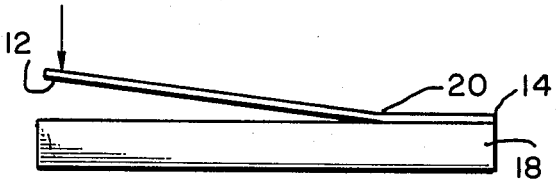
PRIOR ART FIG. 2B
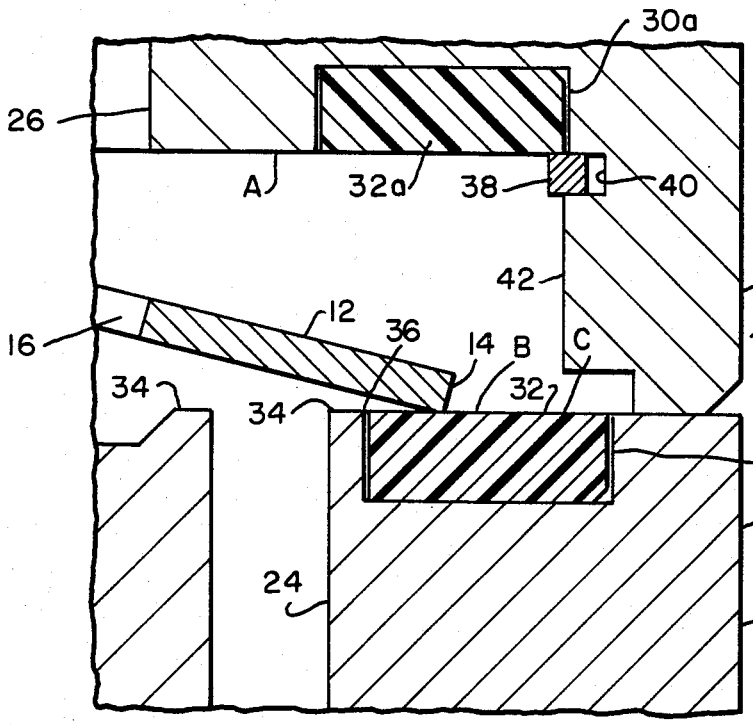
FIG. 3

PLATE-TYPE VALVE, AND AN IMPROVED VALVE SEAT AND A VALVE SEAT ASSEMBLY THEREFOR

This invention pertains to valves, such as the plate-type valves used in reciprocating gas compressors. These valves are essentially one-way devices allowing gas flow in a single direction. The movable valving elements therein respond to pressure differences across them to remove from, and to return to the valve seat thereof, being confined by a ported valve guard. Commonly, closing springs are used to assist the valving elements therein in closing at a particular time relative to the compressor cycle.

One-way, or unidirectional-flow valves come in a variety of types, and the particular one addressed by this disclosure, by way of example, is of the plate-type well known in the prior art. Exemplary thereof are the "Lifting Device for Compressor Valves" U.S. Pat. No. 3,294,314, issued to J. Ott et al., on Dec. 27, 1966, and the "Plate Valve" disclosures in U.S. Pat. Nos. 3,327,731 and 3,945,397, issued to T. K. Kehler, and A. F. Riedel, respectively, on June 27, 1967 and Mar. 23, 1976. Other exemplary valves are disclosed in U.S. Pat. Nos. 3,369,563 and 976,010, issued to A. Deminger for a "Plate type Valve Having a Damper Plate", and to J. C. Thompson for a "Valve", respectively, on Feb. 20, 1968, and Nov. 15, 1910. Commonly, each of the valving elements in such prior art valves, essentially, is a series of concentric rings joined together by webs and strengthened by radial ligaments. They can range in diameter from approximately three inches up to twelve inches, and have a typical plate thickness of 0.080 inches.

Such valving elements, in plate-type valves, cycle as high as twenty times per second with total lifts of approximately 0.060 inches. Typically, impact velocities thereof, at the valve seat, are in the four to eight feet per second range although, in some cases, impacts in excess of ten feet per second have been measured. Impact of the valving element with the valve seat has been shown, experimentally, to produce high stesses in the outer rim near the thereadjacent flow port(s). Typically, the valving element approaches the valve seat in a tilted manner. Contact then takes place over a small area, i.e., a point contact, of the valving element periphery, causing bending. Eventually, the valving element plate material fatigues, and a crack develops, forcing the machine (i.e., gas compressor) to be shut down for repairs to be made.

It is an object of this invention to disclose a plate-type valve comprising first means defining a valve seat; second means defining a valve guard fixed in spaced apart relation to the valve seat; said seat and guard having openings formed therethrough to accommodate a fluid flow therethrough; and valving means, movably interposed between said seat and guard, for occluding and exposing given ones of said openings to inhibit, and to permit, fluid flow therethrough, respectively; wherein one of said first and second means has means defining a flat bearing surface, encompassing a given area and having a given perimeter, for receiving said valving means thereupon; said one means further has a recess formed about said given perimeter; and further including means set in said recess for impacting engagement thereof by, and for dissipating impacting forces of, said valving means.

It is further an object of this invention to disclose a valve seat assembly, for use on a plate-type valve, comprisisng a valve seat; said seat having (a) openings formed therein to accommodate a fluid flow therethrough, (b) a flat beating surface, encompassing a given area and having a given perimeter, for receiving a valving element movably thereon for occluding and exposing said openings, and (c) a recess formed therein circumambient said given perimeter; and means set in said recess for impacting engagement thereof by, and for dissipating impacting forces of, such valving element as is movably received on said bearing surface.

Another object of this invention is to set forth an improved valve seat, for use in a plate-type valve, said seat having (a) openings formed therein to accommodate a fluid flow therethrough, and (b) a flat bearing surface, encompassing a given area and having a given perimeter, for receiving a valving element movably thereon for occluding and exposing said openings, wherein the improvement comprises a recess formed in said seat, circumambient said given perimeter, for nestably and slidably receiving therein an impact-receiving element for dissipating impacting forces of such valving element.

Further objects of this invention, as well as the novel features thereof, will become more apparent by reference to the following description taken in conjunction with the accompanying figures, in which:

FIGS. 1A and 1B are (a) a partial plan view of an edge of a prior art, valving element, and (b) an illustration in simple line drawing of such an element approaching contact with its prior art valve seat, the angle of incidence being shown in exaggeration only to clarify the matter;

FIGS. 2A and 2B illustrations, generally corresponding with FIGS. 1A and 1B, representing the valving element upon its having made contact with the valve seat, and showing a fatigue fracture occuring therein;

FIG. 3 is a partial, cross-sectional view of a first embodiment of the invention; and FIG. 4 is a view generally corresponding to FIG. 3 showing, however, an alternative embodiment of the invention.

As shown in the figures, plate type valving elements, as is well known from the prior art, commonly comprise a plate 12 having a circular edge or periphery 14, and having a plurality of apertures, or flow ports 16, formed therethrough, the same being arrayed, concentrically, about the radial center (not shown) of the plate 12. In use, commonly the plates 12 are cycled at a high rate, and almost always impact on the complementary valve seat 18 at an angle. Consequently, inwardly of the point of contact, bending occurs. Too soon, the plate metal fatigues and experiences a fracture 20, usually through an area adjacent and end of a radially-outermost flow port 16.

In order to render such valving elements more durable and long-lived, the invention contemplates the novel valve 10 having an improved valve seat **18*a*, and valve seat assembly 22**.

Valve seat **18*a* has openings 24 (only one being shown) which, as is conventional in the prior art, are occluded and exposed by the valving element 12 as the latter seats upon, and lifts off from, respectively, the seat 18*a*. Openings 24 are not aligned with ports 16, whereas ports 16 are aligned with ports 26 in the valve guard 28. Valve seat 18*a* further has a recess 30 formed therein in which to receive an impact-dissipating ring 32. The valve seat 18***a* defines a substantially flat bearing surface 34, which encompasses a given area, defined by its perimeter 36. The bearing surface 34 comprises the principal seat for the valving element 12, and the recess 30 is formed circumambient the perimeter 36. The valving element 12, however, encompasses an area greater than the bearing surface 34; accordingly, the periphery 14 of the element 12 overhangs or overreaches the surface 34. Ring 32 is disposed thereat, where it will receive and dissipate the closing impacts of the element 12.

Ring 32 is formed of ductile material, and is loosely and slidably set in the recess 30. Upon the valving element 12 closing upon the valve seat 18*a*, it first impacts the ring 32. This tends to cushion the impact force, by dissipating the energy transfer or reflection which returns back into the valving element 12.

If desired, a like recess 30*a* may be formed in the valve guard 28 in which to nest another impact ring 32*a*—this to cushion the opening impacts of the valving element 12 with the guard 28. Here, however, a retaining ring 38, in a groove 40, is necessary to secure the ring 32*a* in place.

Valve seat 18*a* and valve guard 28 have commonly confronting, active-surface areas "A" and "B", and the element 12 is freely movable therebetween. The inner, circumferential wall 42 defines the outermost bounds of such active-surface areas "A" and "B". Beyond area "B", then, and circumambient thereof, the seat 18*a* has an inactive-surface area "C". The impact ring 32 extends into the latter, from area "B". Accordingly, it is thus assured that the valving element 12 will always impact with the ring 32 at some location intermediate the width of the latter. The ring 32 bridges across the possible inmpact area, from the perimeter 36 to beyond the bounds of the area "B".

In the alternative embodiment 10*a* of FIG. 4, same or similar index numbers denote same or similar structures and/or elements. Here, the valve seat 18*b* has a recess 30 with additional spring-nesting bores 44 (only one is shown) formed therebelow. It is to be understood that there is a plurality of such bores 44 formed in seat 18*b*, at equidistant locations thereabout.

Springs 46 (only one being shown) are set in the bores 44 to support the impact ring 32 in elevation. Accordingly, as the valving element 12 closes toward the seat 18*b*, it impacts the ring 32 in free space. An energy exchange takes place between the ring 32 and element 12, and both descend to the seat 18*b* at a decelerated velocity. Too, on descending into the recess 30, the ring 32 must evacuate a pocket of air (or gas) therewithin. This provides a beneficial pneumatic damping which is additive to the biasing resistance of the springs 46.

While I have described my invention in connection with specific embodiments thereof drawn on plate-type valves, it is to be clearly understood that this is done only by way of example, and not as a limitation to the scope of my invention, as set forth in the objects therof, and in the appended claims. Patently, my teachings herein find ready application to other types of unidirectional-flow, fluid valves which comprise a movable valving element confined by a valve seat and valve guard, or stop plate, or the like.

I claim:

1. A plate-type valve, comprising:

first means defining a valve seat; and second means defining a valve guard fixed in spaced-apart relation to the valve seat; wherein one of said first and second means has means defining a flat bearing surface for receiving valving means thereon;

said seat and guard have openings formed therethrough to accommodate a fluid flow therethrough; and further including valving means, interposed between said seat and guard, and independently movable therebetween (a) to accommodate removal of said valving means from said bearing surface, and to permit impacting closure of said valving means onto said bearing surface, and (b) for occluding and exposing given ones of said openings to inhibit, and to permit, fluid flow therethrough, respectively; wherein said valving means has an outermost periperal edge;

said bearing surface encompasses a given area and has a given perimeter;

said one means further has a recess formed about said given perimeter; and further including means set in said recess for impacting, point-contacting engagement thereof by said peripheral edge of said valving means upon the latter closing upon said bearing surface at an angle relative thereto, thereby to dissipate impacting forces of said valving means.

2. A plate-type valve, according to claim 1, wherein:

said valving means encompasses an area which is greater than, and defines a prescribed perimeter which, fully thereabout, extends beyond said given perimeter; and said dissipating means has a dimension which extends from a proximate adjacency to said given perimeter to beyond said prescribed perimeter.

3. A plate-type valve, according to claim 1, wherein:

said given perimeter is defined by a first radius;

said valving means encompasses an area having a prescribed perimeter;

said prescribed perimeter is defined by a second radius which is greater than said first radius; and said dissipating means comprises an annulus having an inside diameter having a radius which closely approximates said first radius, and an outside diameter having a radius which is greater than said second radius.

4. A plate-type valve, according to claim 1, wherein:

said recess is of annular configuration; and said dissipating means comprises an annulus loosely and slidably set in said recess.

5. A plate-type valve, according to claim 1, wherein:

said dissipating means comprises means for decelerating movement of said valving means in travel thereof toward said seat.

6. A plate-type valve, according to claim 1, wherein:

said dissipating means comprises means for restrictively confining a cushioning pocket of gas within said recess.

7. A plate-type valve, according to claim 1, further including:

means interposed between said dissipating means and said recess for urging said dissipating means outward from said recess.

8. A plate-type valve, according to claim 1, wherein:

said dissipating means is formed of a ductile material.

* * * * *